United States Patent [19]

Cleghorn

[11] 3,986,419

[45] Oct. 19, 1976

[54] MATERIAL CUTTING MACHINE

[75] Inventor: William L. Cleghorn, South San Francisco, Calif.

[73] Assignee: Mathewson Corporation, Quincy, Mass.

[22] Filed: Sept. 18, 1975

[21] Appl. No.: 614,535

[52] U.S. Cl. ..... 83/174; 83/208; 83/282; 83/455; 83/459; 83/461; 83/477.2; 83/478; 83/488

[51] Int. Cl.[2] ..... B26D 7/02; B26D 7/22

[58] Field of Search ..... 83/174, 208, 282, 455, 83/460, 461, 477.2, 478, 488, 454, 456, 466.1, 459

[56] References Cited

UNITED STATES PATENTS

| | | | |
|---|---|---|---|
| 2,713,904 | 7/1955 | Ostuw et al. | 83/208 |
| 3,181,406 | 5/1965 | Sayles | 83/174 |
| 3,641,854 | 2/1972 | Keesling | 83/455 X |
| 3,707,255 | 12/1972 | Ridgway et al. | 83/208 X |
| 3,736,825 | 6/1973 | Covell | 83/174 |
| 3,919,905 | 11/1975 | Hoffman | 83/455 X |

*Primary Examiner*—Frank T. Yost
*Attorney, Agent, or Firm*—Robert T. Gammons

[57] ABSTRACT

A material cutting machine includes a pair of cylindrical rollers through which a web of sheet material is passed, one roller being driven while the other is allowed to track with the sheet material so that it accurately measures the length of the material passing through the rollers. Means are included for stopping the drive roller after a prescribed length of material has been measured by the measuring roller. After such stopping, a cut-off apparatus is made to reciprocate across the web to cut off a predetermined length of material.

12 Claims, 8 Drawing Figures

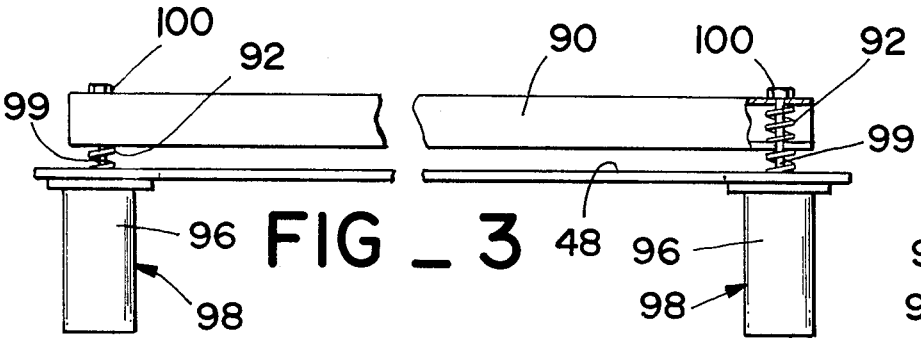
FIG _ 3
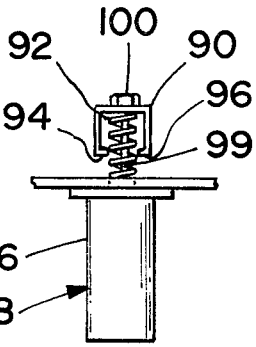
FIG _ 4
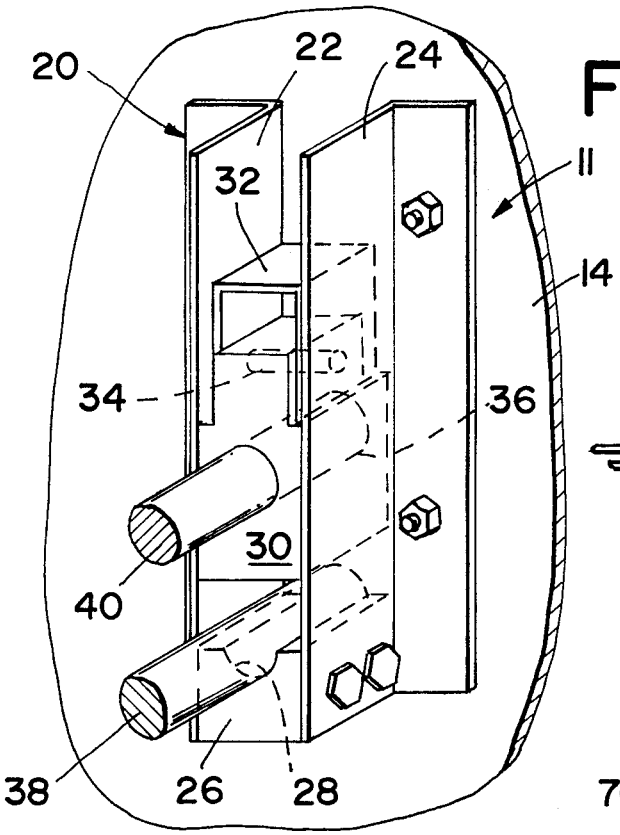
FIG _ 5
FIG _ 6
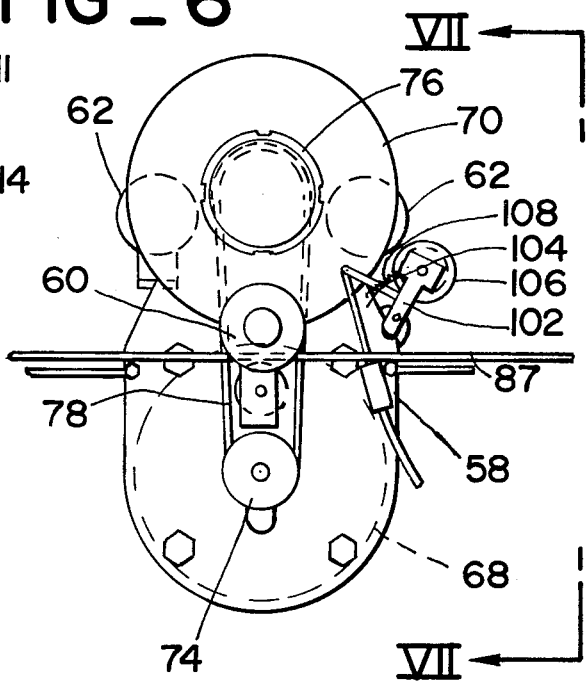
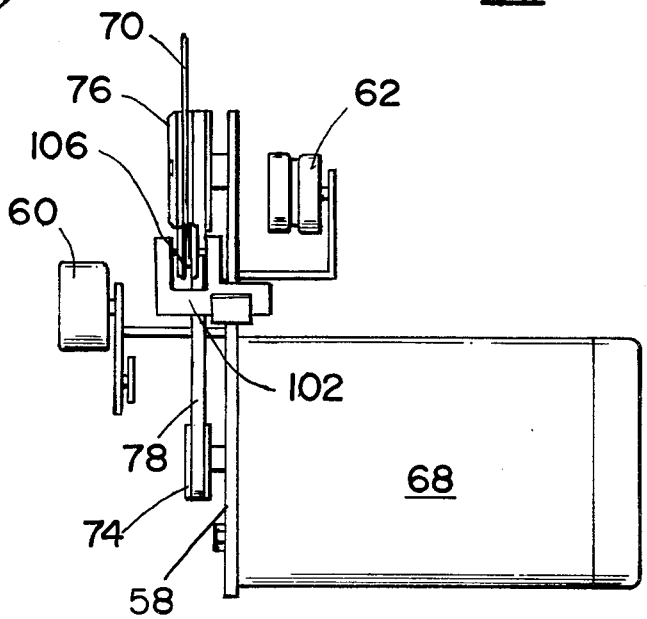
FIG _ 7

MATERIAL CUTTING MACHINE

BACKGROUND OF THE INVENTION

This invention relates to apparatus for measuring and cutting off a web of material, and more particularly, to such an apparatus which is designed to provide such functions in an automated manner.

It will be understood that it is often desirable to provide a plurality of equal length portions of a sheet material from a roll thereof. Under ordinary circumstances, the hand-cutting of such sheet material to provide such portions thereof is relatively time consuming. It should also be understood that, in the use of a machine to provide such cutting, such machines should be extremely efficient and should be easily adjustable so that various cuts of material can be made.

U.S. Pat. No. 3,611,856; U.S. Pat. No. 3,523,392; U.S. Pat. No. 3,620,114; and U.S. Pat. No. 2,527,739 each disclose apparatus for cutting material fed by rollers. It will be understood, however, that it is always desirable to seek a higher efficiency of operation than is disclosed in any of these patents.

SUMMARY OF THE INVENTION

It is accordingly an object of this invention to provide apparatus which is capable of automatically measuring and cutting off a portion of sheet material.

It is a further object of this invention to provide apparatus which, while fulfilling the above object, operates in an extremely efficient and accurate manner.

It is a still further object of this invention to provide apparatus which, while fulfilling the above objects, is relatively simple in design and construction.

Broadly stated, herein is disclosed a machine for feeding and cutting off sheet material. Such machine comprises a frame, and material feed roller means mounted on the frame. Drive means are operatively connected to the roller means, and a table is mounted on the frame adjacent the roller means, the sheet material being feedable onto the table from the roller means. Further included are cutting means movable along a path across the table to engage and cut sheet material overlying the table. An elongated member is mounted on the frame and is movable relative thereto from an upper position spaced from the table to a lower position upon interruption of the drive means wherein an elongated portion thereof contacts material along a side of the path, to press the material against the table, the elongated member in both its upper and lower positions substantially surrounding the cutting means and blocking access thereto along substantially the entire length of movement of the cutting means along the path. Further included are means operable to cause the cutting means to move, upon the interruption of the drive means, along the path and along the elongated member.

BRIEF DESCRIPTION OF THE DRAWINGS

These and other objects of the invention will become apparent from a study of the following specification and the drawings, in which:

FIG. 3 is a front elevation of the elongated clamp means of the apparatus;

FIG. 4 is an end view of the clamp means of FIG. 3;

FIG. 5 is a perspective view of the support means associated with the rollers of the apparatus;

FIG. 6 is a front elevation of the cutting blade and cutting blade motor associated therewith;

FIG. 7 is a view taken along the lines VII—VII of FIG. 6; and

DESCRIPTION OF THE PREFERRED EMBODIMENT

Figure 1:
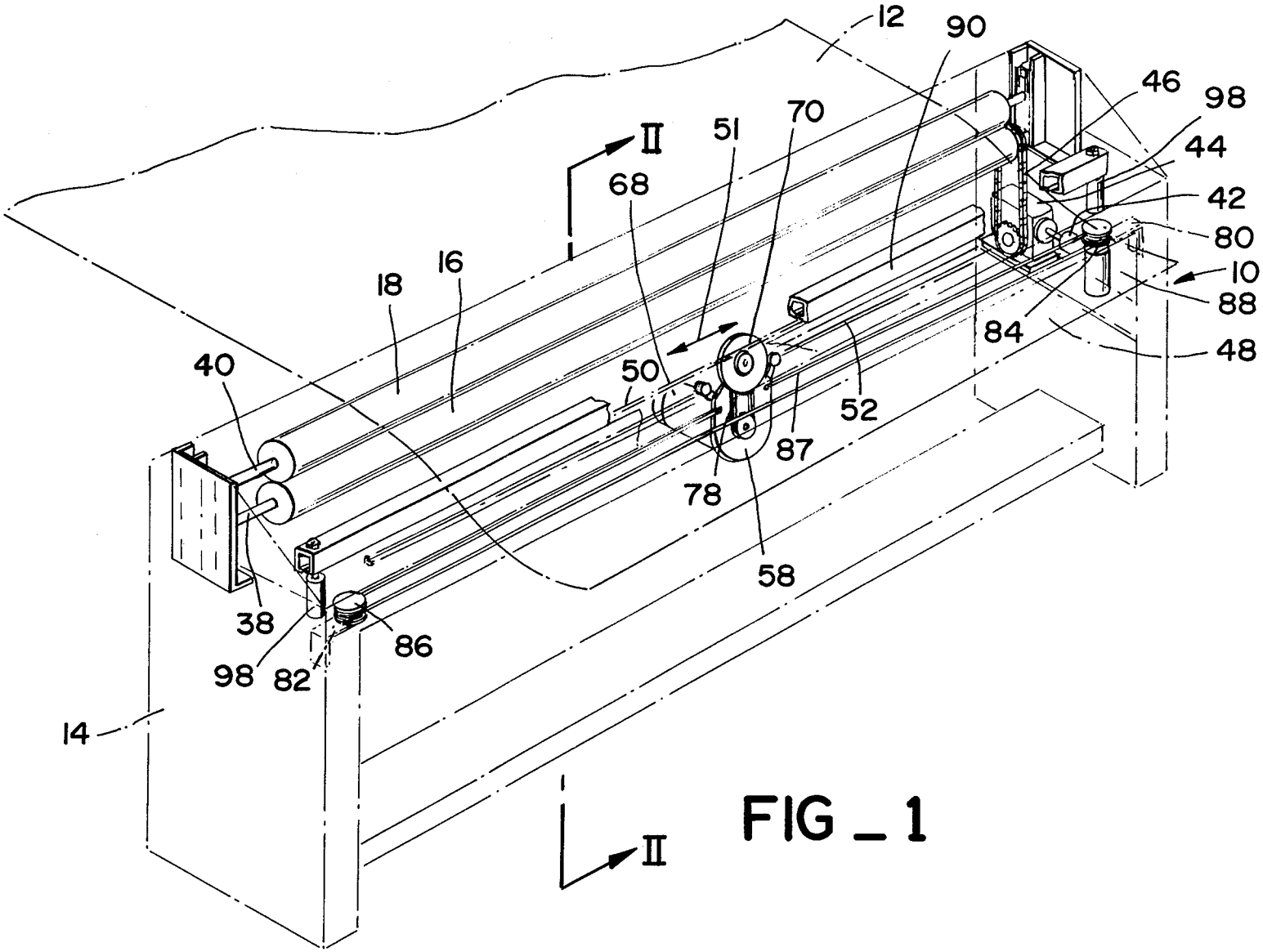
FIG. 1 is an overall perspective view of the apparatus.
Figure 2:
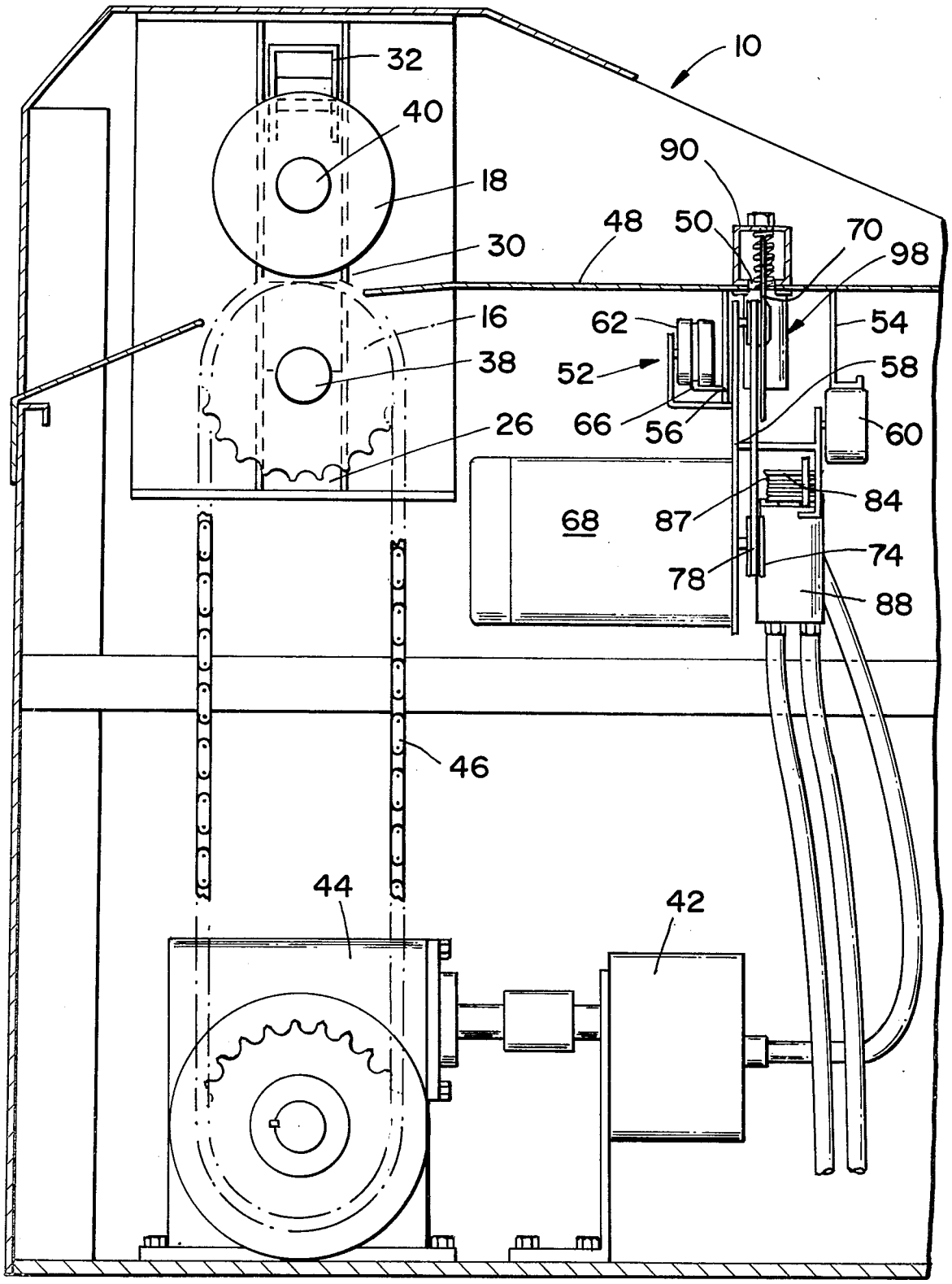
FIG. 2 is a sectional view taken along the lines II—II of FIG. 1.

Shown generally in FIG. 1 is the machine or apparatus 10 for measuring and cutting off sheet material 12. The sheet material 12 is fed from a supply (not shown) into the machine 10. The machine 10 has a frame 14 as shown.

A pair of rollers 16,18 are mounted in the frame 14 by means best shown in FIG. 5. As shown therein, the frame 14 has a bracket 20 fixed thereto. The bracket 20 defines parallel side walls 22,24 to which are secured a block 26 of Teflon or the like, defining a channel 28 therein. An upper mounting block 30, also of Teflon or the like, is slidably disposed between the side walls 22,24, and has a brace portion 32 fixed thereto by means of a pin 34. The upper block 30 is slidable upwardly and downwardly between the walls 22,24 and defines an aperture 36 therethrough which is disposed parallel to the channel 28.

The rollers 16,18 are mounted on elongated axles 38,40. An adjacent pair of the ends of the axles 38,40 are mounted in the aperture 36 and channel 28 respectively. It will be understood that a like structure is associated with the rollers 16,18 at their opposite adjacent ends.

It will be seen that with sheet material 12 disposed on the bottom roller 16, the surface of the top roller 18 will contact such sheet material 12, the free sliding movement of the blocks 26,30 upwardly and downwardly relative to the brackets 20 associated therewith allowing for different thicknesses of material 12.

The bottom roller 16 is driven by a hydraulic motor 42 through a transmission gear box 44 and a chain 46, the hydraulic motor 42 communicating with a hydraulic pump (not shown) as is well known. Because of such hydraulic system, it is to be understood that the speed of the drive roller 16 may be varied over a wide range through selective variation of the speed of the motor 42.

Fixed to the frame 14 forwardly of the rollers 16,18 is a table 48 onto which the sheet material 12 is fed from the rollers 16,18. The table 48 defines an elongated slot 50 generally parallel to the cylindrical axes of the rollers 16,18.

Cutting apparatus is associated with the table and slot as shown in FIGS. 1, 2, 6 and 7. As shown therein, a track 52 made up of angle members 54,56 is fixed to the underside of the table 48 running along the slot 50. A carriage 58 has rollers 60,62 fixed thereto, with roller 60 rollably in contact with the underside of the angle member 54, and rollers 62 defining grooves 64 which engage with ribs 66 defined by and extending upwardly of the angle member 56. An electric motor 68 is mounted to the carriage 58, and it will be seen that the motor 68 is mounted in a cantilevered fashion, with the roller 60 applying force upwardly to the angle member 54, and the rollers 62 applying downward force to the angle member 56.

Rotatably fixed to the carriage 58 is a rotary cut-off blade 70. The carriage 58, it will be seen, is movable along the slot 50 upon the rolling of the rollers 60,62, and the body of the cut-off blade 70 is disposed below the table 48, having a cutting portion 72 extending upwardly into and through the slot 50. The slot 50 defines the path 51 along which the rotary cut-off blade 70 is movable.

Pulleys 74,76 are mounted on the motor 68 and the blade 70 respectively and a drive belt 78 interconnects the pulleys 74,76. The motor 68 is an electric motor which is to be driven at constant speed in a manner to be described.

It will be seen that the rotary cut-off blade 70 is positioned to move across the table to engage and cut sheet material 12 overlying the table 48.

Rotatably fixed to brackets 80,82 (which are in turn fixed relative to frame 14) are pulleys 84,86. These pulleys 84,86 are positioned adjacent opposite ends of the slot 50, and a drive belt 87 has one end fixed to the carriage 58, is wound around the pulley 84, and the pulley 86 has its opposite end also fixed to the carriage 58. A reversible hydraulic drive motor 88 drives the pulley 84, such hydraulic drive motor 88 being driven by the hydraulic pump similar to the hydraulic motors previously described. It will again be seen that because of the choosing of such hydraulic system, the speed of the rotary cut-off blade 70 along the path 51 may be selectively varied.

The hydraulic system described will also provide the advantage that if tension on the material 12 to be fed becomes too great, the hydraulic motor 42 will slip avoiding any damage to the system. This point applies if the material were to become jammed, since a bypass valve would be included in the system as is well known.

An elongated clamping member or clamping bar 90 is positioned along and above the slot 50, and is associated with the table 48 by means of springs 92, each spring 92 extending between the top of the table 48 and an end of the elongated bar 90. The elongated bar 90 is of inverted U-shape, defining downwardly extending continuous edge portions 94,96. The table 48 has fixed thereto the bodies 97 of hydraulic cylinders 98, and the rods 99 thereof extending between the respective springs 92 and through appropriate apertures in the ends of the elongated clamping bar 90, the extended ends of the rods 99 having nuts 100 fixed thereto as shown. It will be seen that retraction of the cylinders 98 forces the edge portions 94,96 of the elongated clamping bar 90 into contact with the table 48 against the resilience of the springs 92. Release of the hydraulic cylinders 98 allows the springs 92 to move the elongated clamping bar 90 upwardly from the table 48. The cylinders 98 are acutated by a solenoid actuated valve the operation of which will be described in detail.

It will be seen that the elongated clamping bar 90 is movable relative to the frame 14 from an upper position spaced from the table 48 to a lower position wherein the elongated edge portions 94,96 can contact material 12 along both sides of the slot 50 to press the material against the table 48. It should be noted that because of the inverted substantially U-shape of the cross-section of the elongated clamping bar 90, such elongated clamping bar 90 substantially surrounds the rotary cut-off blade 70 and blocks access thereto along substantially the entire length of movement of the rotary cut-off blade 70 along the path 51.

As shown in FIGS. 6 and 7, an arm 102 is pivotally mounted to the carriage 58, and has an extension 104 fixed thereto. The extended end of the arm 102 has rotatably mounted thereon a grinding wheel 106, disposed below the table 48 adjacent the motor 68. The carriage 58 has fixed thereto a solenoid Sol S, which normally holds the extension 104 in a position to hold the grinding wheel 106 away from the cutting edge of the rotary cut-off blade 70 against the resilience of a spring 108 which interconnects the arm 102 and carriage 58. Upon the actuation of the solenoid Sol S, the spring 108 will bring the rotary grinding wheel 106 into contact with the cutting edge of the rotary cut-off blade 70.

The drive condition of the hydraulic motor 42 is determined by actuation of a solenoid valve Sol D (FIG. 8) in the well-known manner. Similarly, the actuation of the cylinders 98 is determined by the actuation of a solenoid valve Sol H. The driving of the hydraulic motor 88 in one or the other directions is determined by the actuation of solenoid valves Sol F and Sol R respectively.

Figure 8:
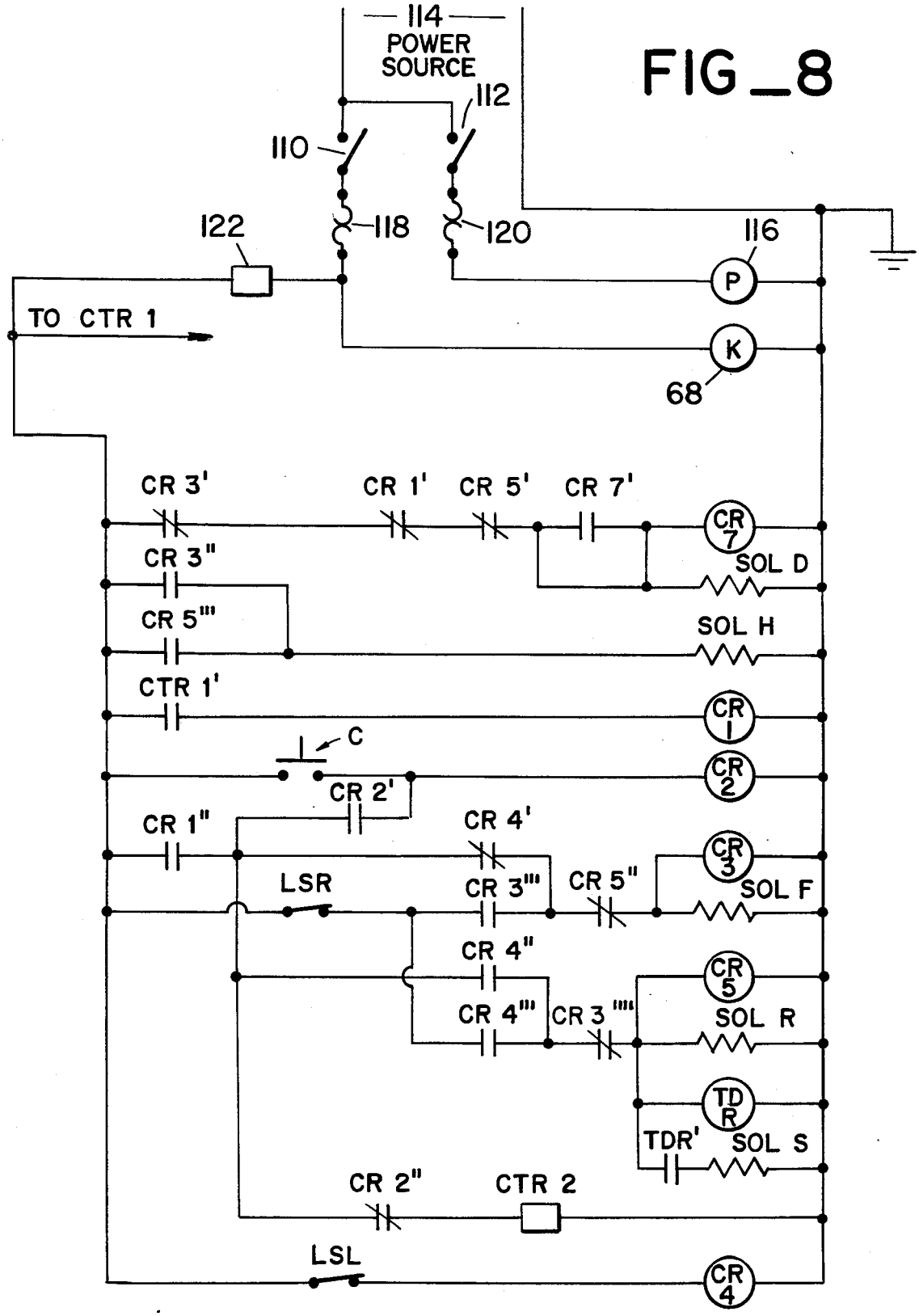
FIG. 8 is a schematic diagram showing the electrical circuitry of the apparatus.

The electrical circuit and means associated therewith for causing the apparatus 10 to automatically operate are shown in FIG. 8. Initially, the apparatus 10 is started with the carriage 88 in its extreme leftward position (FIG. 1). Switches 110,112 are closed to supply power from a power source 114 to the hydraulic pump 116 and the knife rotating motor 68. Overload relays 118,120 are associated with the switches 110,112 as shown. Power is also supplied through a fuse 122 through a normally closed relay CR3′ and through normally closed relays CR1′ and CR5′ to Sol D which actuates the drive motor 42 so that material 12 is fed through the rollers 16,18. Power is also supplied to relay driver CR7, closing relay CR7′. Counter CTR1 is chosen to close relay CTR1′ upon the counter reaching a number chosen, and relay CTR1′ will remain closed until the counter is reset.

Upon the counter CTR1 reaching such chosen number, determined by the number of rotations of the roller 16, relay CTR1′ is closed to energize relay driver CR1. The energizing of relay driver CR1 opens relay CR1′ and stops the drive roller rotation. With the driver roller rotation having stopped, the feed of material thereby has stopped, after a certain length has been fed thereby, as determined by the number set on counter CTR1. This determines the length of the finished panel. Also, relay CR1″ is closed, and will remain closed until such counter CTR1 is reset.

The closing of relay CTR1′ energizes counter CTR2 through relay CR2″ to feed the counter CTR2 a single impulse, with a full energizing and the deenergizing of such counter CTR2 giving one full count thereof. Also, through the closing of relay CR1″, power is supplied through relay CR4′, and relay CR5″ to Sol F, actuating motor 88 to drive the carriage 58 from left to right. Also, relay driver CR3 is energized, closing relay CR3″ which energizes Sol H to actuate the cylinders 98 to bring the clamp edges 94,96 into contact with the material 12 to urge such material 12 against the table 48 on both sides of the slot 50. Power is supplied to Sol F through normally closed limit switch LSR, and through a parallel line including relay CR4′. It should be noted that the limit switches LSR and LSL are both normally closed, the limit switch LSR being opened by the carriage 58 upon extreme rightward movement of the carriage 58, and the limit switch LSL being opened by the carriage 58 upon extreme leftward movement of the carriage 58.

The carriage 58 now starts to move to the right, and as such carriage 58 initially moves, limit switch LSL, initially being held open with the carriage 58 in its extreme leftward position, closes, to energize relay driver CR4. Relays CR4'', CR4''' close and relay CR4' opens, so that parallel power is no longer supplied to Sol F. However, Sol F continues to receive power through limit switch LSR. It should be noted that relay CR3'''' is open, so that no power can reach Sol R.

At approximately the middle of travel of the carriage 58, a reset limit switch (not shown) is closed by movement of such carriage 58, to reset counter CTR1. Relay CTR1' opens and relay CR1'' opens meanwhile with the relay CR1' reclosing.

Upon the energizing of relay driver CR3 through application of power of Sol F, relay CR3' was opened. So the line of power to Sol D was actually opened in two places, i.e., relay CR3' and relay CR1'. This is true before the mid-point switch described above is reached. Upon such energizing relay driver CR1, closing relay CR1''. However, as pointed out above, relay CR3' remains open. Relay CR1'' opens simultaneously with the closing of the relay CR1', deenergizing counter CTR2, to complete one count thereof. Such one count corresponds to the cutting of one piece of material 12.

As the carriage 58 now approaches the extreme right position of its travel, such carriage 58 will open limit switch LSR. Relay CR1'' has been opened by the reset of the counter CTR1, and limit switch LSR has been energizing relay CR3''', and Sol F. Upon the opening of limit switch LSR, relay driver CR3 and Sol F are deenergized, ending the left-to-right movement of carriage 58. With relay driver CR3 deenergized, relay CR3'' opens, deenergizing Sol H to allow the cylinders 98 to release to in turn allow the springs 92 to raise the bar 90 above the table 48 and away from the material 12. Relay CR3' also has closed, closing the circuit to Sol D to actuate the roller 16 to in turn feed material through the rollers 16,18, which feed will end upon a certain number of turns of roller 16 being achieved.

Counter CTR1 again energizes relay CR1'' through the closing of relay CTR1 as above. The closing of relay CR1'' energizes counter CTR2 as above. The limit swich LSR, having been held open by the carriage 58 in its extreme righward position, is allowed to close upon the initial movement of the carriage 58 from its right to its left position, and relay driver CR4 is energized thereby. Relay CR4' is opened, and relays CR4''' and CR4'''' are closed thereby, to energize Sol R, and also relay driver CR5. Relay CR5''' is in turn actuated thereby, supplying power to Sol H to acutate the cylinders 98 to bring the edges of the bar 90 down into contact with the material 12 on the table 48. Time delay relay TDR' is also actuated by relay driver TDR, and will stay closed a predetermined length of time in the range of from 0-5 seconds. The time delay relay TDR' actuates Sol S to allow the spring 108 to bring the grinding wheel 106 into engagement with the edge of the rotating blade 70, to sharpen it for a predetermined length of time. Upon such length of time having passed, time delay relay TDR' will open to operate Sol S to move the grinding wheel 106 away from the edge of the blade 70. It will be seen that the extent of sharpening of the blade 70 may be varied by the setting of the time delay relay TDR' to sharpen the blade 70 for a chosen length of time between 0-5 seconds.

With limit switch LSR closing, parallel power is supplied to Sol R. The carriage 58 trips the switch described above at substantially the mid-point of its travel, resetting counter CTR1 and opening relay CTR1'. Relay driver CR5 is energized, resulting in relay CR5' being open so that power cannot be supplied to Sol D to actuate the drive roller 16. Again, counter CTR2 has been given one more count, similar to the process described previously.

Upon the carriage 58 reaching its extreme leftward travel, limit switch LSL is opened deenergizing relay drive CR4, to in turn open relays CR4''CR'''. If the full travel of the carriage 58 from right to left has taken less time than the setting of the time delay relay TDR', power is cut off to the time delay relay TDR' to in turn end the sharpening of the blade 70. The power is cut off to relay driver CR5, to open relay CR5''' to cut off power to Sol H, to allow the springs 92 to raise the bar 90. It will be seen that Sol D is actuated thereby through the closing of relay CR5', to start the drive roller 16 again.

It will be seen that the operation may be repeated automatically in a continuous fashion, with the counter CTR2 counting the actual number of panels of material cut.

The cut button C allow the operator to stop the feed and cut off material 12 at any time he chooses. Closing the cut button C energizes relay driver CR2, to close relay CR2'. This duplicates in effect the closing of the relay CR1'' to make a cut from either direction. However, relay CR2'' is open so that a reading is not given on counter CTR2.

During such travel, the mid-point switch described above is tripped to re-zero the counter CTR1 so that the next panel will be the proper length as determined by the setting of the counter CTR1.

What is claimed is:

1. A machine for feeding and cutting off sheet material comprising:

a frame;

material feed roller means mounted on the frame;

drive means operatively connected to the roller means;

a table mounted on the frame adjacent the roller means and onto which the sheet material is fed from said roller means;

cutting means movable along a path across the table to engage and cut sheet material overlying the table;

an elongated member mounted on said frame and movable relative thereto from an upper position spaced from said table to a lower position upon interruption of the drive means wherein an elongated portion thereof contacts material along a side of said path, to press the material against the table, the elongated member in both its upper and lower positions substantially surrounding the cutting means and blocking access thereto along substantially the entire length of movement of said cutting means along said path; and means operable to cause said cutting means to move, upon the interruption of the drive means, along said path and along said elongated member.

2. The machine of claim 1 wherein the table defines an elongated slot which defines the path along which the cutting means is movable, the elongated member comprising an elongated bar defining edge portions, disposed on both sides of the slot to press said material against the table on both sides of the slot.

3. The machine of claim 2 wherein the cutting means comprise a carriage movable long the slot, and a cut-off blade mounted to the carriage, the body of the blade being disposed below the table, and having a cutting portion extending upwardly into and through the slot.

4. The machine of claim 3 wherein the cut-off blade comprises a rotary-cut-off blade.

5. The machine of claim 1 and means for selectively varying the speed of the cutting means along said path.

6. The machine of claim 5 and means for selectively varying the speed of the drive means to in turn vary the feeding speed of the material.

7. The machine of claim 4 and sharpening means associated with said blade, and means associated with said sharpening means for providing that a degree of sharpening of the blade takes place upon a given movement of the cutting means along said path across the table.

8. The machine of claim 7 and means for varying the extent of sharpening of the blade for said given movement of the cutting means along said path across the table.

9. The machine of claim 8 wherein the sharpening means comprise a rotary grinding wheel engageable with the blade.

10. The machine of claim 9 wherein the rotary grinding wheel is disposed below the table.

11. The machine of claim 10 and means for selectively varying the speed of the cutting means along said path.

12. The machine of claim 11 and means for selectively varying the speed of the drive means to in turn vary the feeding speed of the material.

* * * * *